US009297534B2

(12) United States Patent
Citeno et al.

(10) Patent No.: US 9,297,534 B2
(45) Date of Patent: Mar. 29, 2016

(54) COMBUSTOR PORTION FOR A TURBOMACHINE AND METHOD OF OPERATING A TURBOMACHINE

(75) Inventors: Joseph Citeno, Greenville, SC (US); Dmitry Alexandrovitch Lysenko, Trondheim (NO); Sergey Anatolievich Meshkov, Moscow (RU); Valery Alexandrovich Mitrofanov, Saint-Petersburg (RU); Almaz Valeev, Kazan (RU)

(73) Assignee: General Electric Company, Schenectady, NY (US)

( * ) Notice: Subject to any disclaimer, the term of this patent is extended or adjusted under 35 U.S.C. 154(b) by 1081 days.

(21) Appl. No.: 13/193,865

(22) Filed: Jul. 29, 2011

(65) Prior Publication Data

US 2013/0025289 A1 Jan. 31, 2013

(51) Int. Cl.
*F23R 3/34* (2006.01)
*F23R 3/28* (2006.01)

(52) U.S. Cl.
CPC ..... *F23R 3/286* (2013.01); *F23R 3/343* (2013.01); *F23R 3/346* (2013.01)

(58) Field of Classification Search
CPC ..... F02C 7/22; F02C 7/228; F02C 9/26; F02C 9/24; F23R 3/34; F23R 3/343; F23R 3/346; F23R 3/286
USPC ..... 60/732–734, 737–739
See application file for complete search history.

(56) References Cited

U.S. PATENT DOCUMENTS 3,872,664 A 3/1975 Lohmann et al.
4,292,801 A * 10/1981 Wilkes et al. ..... 60/776
4,420,929 A 12/1983 Jorgensen et al.
4,984,429 A * 1/1991 Waslo ..... F23R 3/346 60/752

(Continued)

FOREIGN PATENT DOCUMENTS

CN 1763434 A 4/2006
EP 0845634 A2 6/1998

(Continued)

OTHER PUBLICATIONS

International Search Report for PCT Application No. PCT/RU2011/000908, dated Sep. 26, 2012, pp. 1-3.

(Continued)

*Primary Examiner* — Andrew Nguyen
(74) *Attorney, Agent, or Firm* — Ernest G. Cusick; Frank A. Landgraff

(57) ABSTRACT

A turbomachine combustor portion includes a combustion chamber. A center injection nozzle is arranged within the combustion chamber and includes a center nozzle inlet and a center nozzle outlet. An outer premixed injection nozzle is positioned radially outward of the center injection nozzle and includes an outer nozzle inlet and an outer nozzle outlet that is arranged upstream of the center nozzle outlet. A late lean injector is positioned downstream of the center nozzle and the outer premixed nozzle. The combustor portion includes a first combustion zone arranged downstream of the outer nozzle outlet, a second combustion zone arranged downstream of the center nozzle outlet, and a third combustion zone arranged further downstream of the center nozzle outlet. The center injection nozzle, outer premixed injection nozzle, and late lean injector are selectively operated to establish a combustion flame front in the first, second, and third combustion zones.

11 Claims, 6 Drawing Sheets

(56) References Cited

U.S. PATENT DOCUMENTS

| | | | | |
|---|---|---|---|---|
| 5,575,154 | A * | 11/1996 | Loprinzo | 60/746 |
| 5,687,571 | A | 11/1997 | Althaus et al. | |
| 5,749,219 | A | 5/1998 | DuBell | |
| 5,974,781 | A | 11/1999 | Correa et al. | |
| 6,047,550 | A | 4/2000 | Beebe | |
| 6,192,688 | B1 | 2/2001 | Beebe | |
| 6,311,471 | B1 | 11/2001 | Waldherr et al. | |
| 6,868,676 | B1 | 3/2005 | Haynes | |
| 7,546,735 | B2 | 6/2009 | Widener | |
| 8,172,568 | B2 | 5/2012 | Kashihara et al. | |
| 8,381,532 | B2 | 2/2013 | Berry et al. | |
| 8,656,721 | B2 | 2/2014 | Matsumoto et al. | |
| 8,689,559 | B2 | 4/2014 | Kraemer et al. | |
| 2001/0049932 | A1 * | 12/2001 | Beebe | 60/39.06 |
| 2004/0055308 | A1 * | 3/2004 | Blomeyer | 60/737 |
| 2004/0211186 | A1 * | 10/2004 | Stuttaford et al. | 60/737 |
| 2008/0264033 | A1 | 10/2008 | Lacy et al. | |
| 2009/0071159 | A1 | 3/2009 | Parker et al. | |
| 2009/0084082 | A1 | 4/2009 | Martin et al. | |
| 2010/0011771 | A1 * | 1/2010 | Evulet et al. | 60/746 |
| 2010/0018209 | A1 | 1/2010 | Ramier et al. | |
| 2010/0018210 | A1 | 1/2010 | Fox et al. | |
| 2010/0170252 | A1 | 7/2010 | Venkataraman et al. | |
| 2013/0174558 | A1 | 7/2013 | Stryapunin | |
| 2013/0283801 | A1 | 10/2013 | Romig et al. | |
| 2014/0190170 | A1 | 7/2014 | Cai et al. | |

FOREIGN PATENT DOCUMENTS

| | | | |
|---|---|---|---|
| JP | 988628 | A | 3/1997 |
| WO | 2009038652 | A2 | 3/2009 |
| WO | 2013073984 | A1 | 5/2013 |

OTHER PUBLICATIONS

CN Office Action issued on Apr. 3, 2015 in relation to corresponding CN application 201210263271.7.

Chinese Office Action for CN Application No. 201180074781.3, dated Jan. 15, 2015, pp. 1-21.

* cited by examiner

COMBUSTOR PORTION FOR A TURBOMACHINE AND METHOD OF OPERATING A TURBOMACHINE

TECHNICAL FIELD

The subject matter disclosed herein relates to the art of turbomachines and, more particularly, to a combustor portion for a turbomachine.

BACKGROUND OF THE INVENTION

In general, gas turbomachines combust a fuel/air mixture that releases heat energy to form a high temperature gas stream. The high temperature gas stream is channeled to a turbine portion via a hot gas path. The turbine portion converts thermal energy from the high temperature gas stream to mechanical energy that rotates a turbine shaft. The turbine portion may be used in a variety of applications, such as for providing power to a pump or an electrical generator.

Turbomachine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below federal and state mandated levels. One method of achieving low NOx levels is to ensure good mixing of fuel and air prior to combustion and providing an environment that leads to more complete combustion of the fuel/air mixture.

BRIEF DESCRIPTION OF THE INVENTION

According to one aspect of the exemplary embodiment, a turbomachine combustor portion includes a combustor body having a combustor outlet and a combustion liner arranged within the combustor body. The combustion liner defines a combustion chamber. A center injection nozzle is arranged within the combustion chamber. The center injection nozzle has a center nozzle inlet and a center nozzle outlet. An outer premixed injection nozzle is positioned radially outward of the center injection nozzle. The outer premixed injection nozzle includes an outer nozzle inlet and an outer nozzle outlet that is arranged upstream of the center nozzle outlet. A late lean injector is positioned downstream of the center nozzle and the outer premixed nozzle. The combustor portion includes a first combustion zone arranged downstream of the outer nozzle outlet and upstream of the center nozzle outlet, a second combustion zone arranged downstream of the center nozzle outlet, and a third combustion zone arranged further downstream of the center nozzle outlet. The center injection nozzle, outer premixed injection nozzle, and late lean injector are selectively operated to establish a combustion flame front in the first, second, and third combustion zones based upon a desired operating mode of the turbomachine.

According to another aspect of the exemplary embodiment, a method of operating a turbomachine includes operating the turbomachine in a part load mode wherein a first combustible mixture passing from an outer premixed injection nozzle is combusted in a first combustion zone forming a first combustion reaction. The first combustion zone extends about a center injection nozzle. A fluid is passed through the center injection nozzle into a second combustion zone. The fluid passing through the center injection nozzle bypasses the first combustion reaction in the first combustion zone. A fluid is passed into a third combustion zone arranged downstream from the first and second combustion zones. The fluid passing into the third combustion zone bypasses the combustion reaction in the first and second combustion zones.

According to yet another aspect of the exemplary embodiment, a turbomachine includes a compressor portion, a turbine portion operatively connected to the turbine portion, and a combustor portion fluidly connected to the turbine portion. The combustor portion includes a combustor body having a combustor outlet, and a combustion liner arranged within the combustor body. The combustion liner defines a combustion chamber. A center injection nozzle is arranged within the combustion chamber. The center injection nozzle has a center nozzle inlet and a center nozzle outlet. An outer premixed injection nozzle is positioned radially outward of the center injection nozzle. The outer premixed injection nozzle includes an outer nozzle inlet and an outer nozzle outlet that is arranged upstream of the center nozzle outlet. A late lean injector is positioned downstream of the center nozzle outlet. The combustor portion includes a first combustion zone arranged downstream of the outer nozzle outlet and upstream of the center nozzle outlet, a second combustion zone arranged downstream of the center nozzle outlet, and a third combustion zone arranged further downstream of the center nozzle outlet. The center injection nozzle, outer premixed injection nozzle, and late lean injector are selectively operated to establish a combustion flame front in the first, second, and third combustion zones based upon a desired operating mode of the turbomachine.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of an injection nozzle. The terms "radial" and "radially" as used in this application refer to directions and orientations extending substantially orthogonally to the center longitudinal axis of the injection nozzle. The terms "upstream" and "downstream" as used in this application refer to directions and orientations relative to an axial flow direction with respect to the center longitudinal axis of the injection nozzle.

Figure 1:
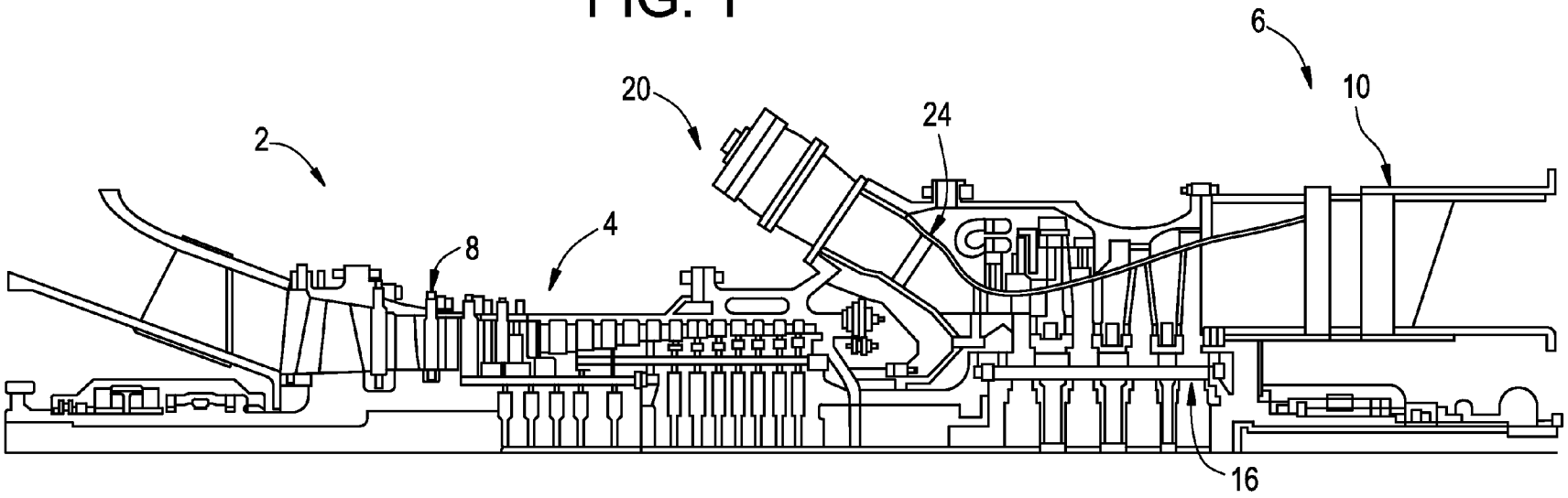
FIG. 1 is partial cross-sectional view of a turbomachine including a combustor portion coupled to a turbine portion through a transition piece in accordance with an exemplary embodiment.

With reference to FIG. 1, a turbomachine system constructed in accordance with an exemplary embodiment is indicated generally at 2. Turbomachine system 2 includes a compressor portion 4 and a turbine portion 6. Compressor portion 4 includes a compressor housing 8 and turbine portion 6 includes a turbine housing 10. Compressor portion 4 is linked to turbine portion 6 through a common compressor/turbine shaft or rotor 16. Compressor portion 4 is also linked to turbine portion 6 through a plurality of circumferentially spaced combustor portions, one of which is indicated at 20. Combustor portion 20 is fluidly connected to turbine portion 6 by a transition piece 24.

Figure 2:
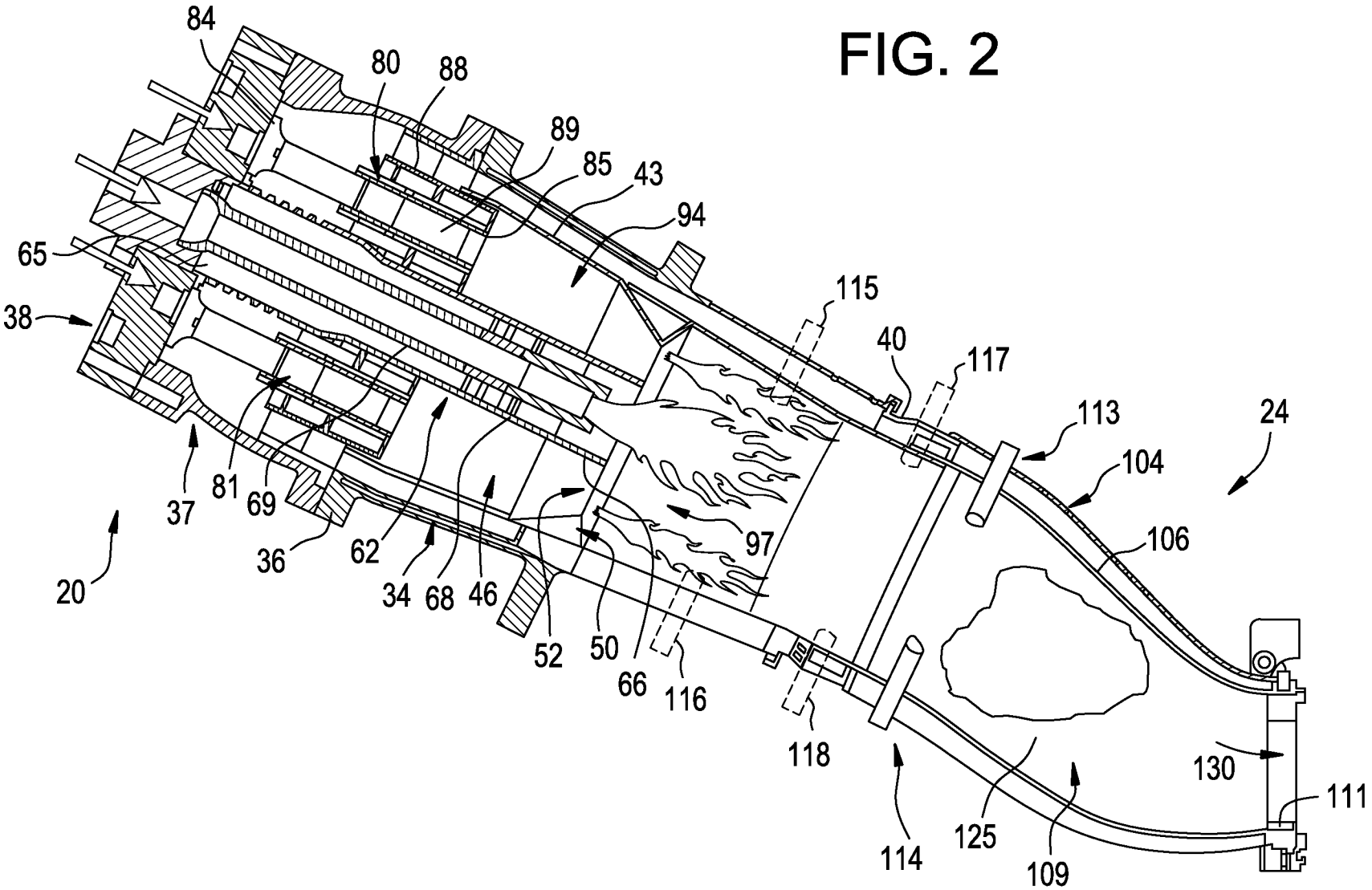
FIG. 2 is a cross-sectional view of the combustor portion and transition piece of FIG. 1 shown in a base load operational mode.
Figure 6:
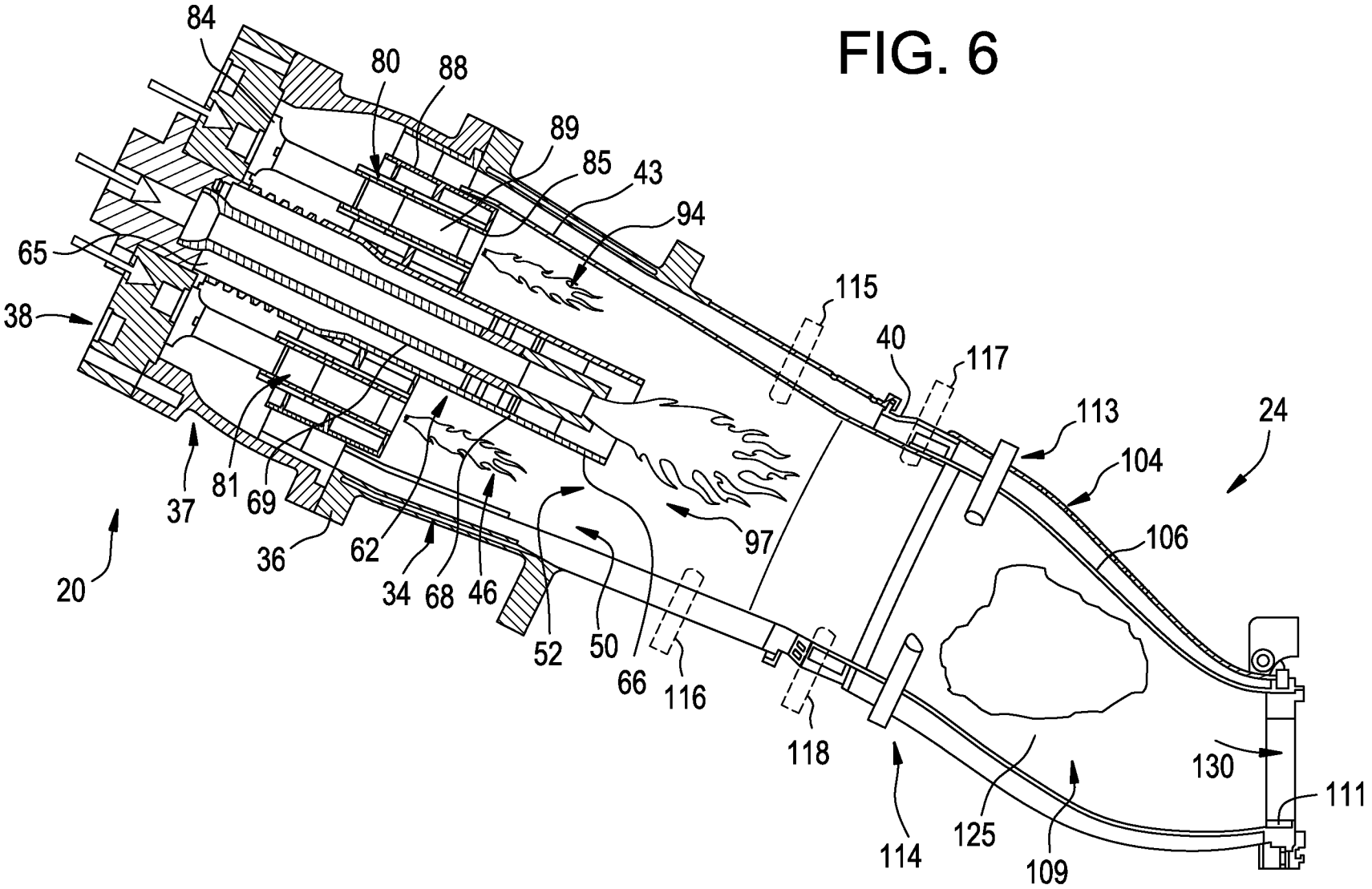
FIG. 6 is a cross-sectional view of another exemplary embodiment of the combustor portion and transition piece of FIG. 1 shown in a base load operational mode.

As best shown in FIG. 2, combustor portion 20 includes a combustor body 34 having a forward end 36 to which is mounted an injector nozzle housing 37. An endcover 38 is mounted to injector nozzle housing 37. Forward end 36 extends to a combustor outlet 40. In the exemplary embodiment shown, combustor portion 20 includes a combustor liner 43 arranged within and spaced from an inner surface (not separately labeled) of combustor body 34. Combustor liner 43 defines a combustion chamber 46. In further accordance with the exemplary embodiment shown, combustor portion 20 includes a venturi 50 provided on combustor liner 43. Venturi 50 includes a venturi throat 52 that operates to stabilize a combustible mixture passing through combustion chamber 46. At this point, it should be understood that combustor portion 20 could also be formed without the venturi, as shown in FIG. 6.

Combustor portion 20 is also shown to include a center injection nozzle 62 that extends substantially along a centerline of combustion chamber 46. Center injection nozzle 62 includes a first end or center nozzle inlet 65 that extends from injection nozzle housing 37 to a second end or center nozzle outlet 66. Center injection nozzle 62 includes a center nozzle housing 68 within which extends a centerbody 69. Center injection nozzle 62 receives fuel and air through ports (not separately labeled) in endcover 38. As such, center injection nozzle 62 constitutes a pre-mixed injection nozzle or an injection nozzle that mixes fuel and air to form a combustible mixture. Of course, it should be understood that the combustible mixture could include other constituents such as various diluents.

Combustor portion 20 also includes a plurality of outer premixed injection nozzles, two of which are indicated at 80 and 81 that are disposed in an annular array radially outward from center injection nozzle 62. The term "premixed injection nozzle" should be understood to mean an injection nozzle in which fuel and air are mixed so as to have greater than a 50% mixedness or homogeneity. In accordance with one aspect of the exemplary embodiment, premixed injection nozzles 80 and 81 have greater than 80% mixedness. As each outer premixed injection nozzle 80, 81 is similarly formed, a detailed description will follow with reference to premixed injection nozzle 80 with an understanding that premixed injection nozzle 81 includes corresponding structure. It should also be understood that the number of outer premixed injection nozzles can vary.

Outer premixed injection nozzle 80 includes a first end or outer nozzle inlet 84 that is coupled to injection nozzle housing 37. Outer nozzle inlet 84 extends to an outer nozzle outlet 85 that is arranged upstream from center nozzle outlet 66. Outer premixed injection nozzle 80 also includes an outer injection nozzle housing 88 that surrounds a centerbody 89. In a manner similar to that described above, outer premixed injection nozzle 80 constitutes a pre-mixed injection nozzle or an injection nozzle that mixes fuel and air to form a combustible mixture. As will become more fully evident below, combustor portion 20 includes a first combustion zone 94 that extends between each outer nozzle outlet 85 and center nozzle outlet 66, and a second combustion zone 97 that extends from center nozzle outlet 66 toward combustor outlet 40.

In further accordance with the exemplary embodiment, transition piece 24 includes an impingement sleeve 104 that surrounds a transition piece body 106. Transition piece body 106 defines a flow path 109 that extends from combustor outlet 40 to a transition piece outlet 111. Transition piece 24 is also shown to include a plurality of late lean injectors (LLI), two of which are shown at 113 and 114. In certain operating modes, LLI 113 and 114 introduce a fuel/air or combustible mixture into flow path 109 to establish a third combustion zone 125. While shown on transition piece 24, it should be understood that late lean injectors such as shown 115 and 116 can be arranged on combustor body 34, or late lean injectors such as shown at 117 and 118 can be arranged at an interface between combustor body 34 and transition piece 24. As will be discussed more fully below, combustion gases are formed in one or more of combustion zones 94, 97, and 125 depending upon an operating mode of turbomachine 2.

Figure 3:
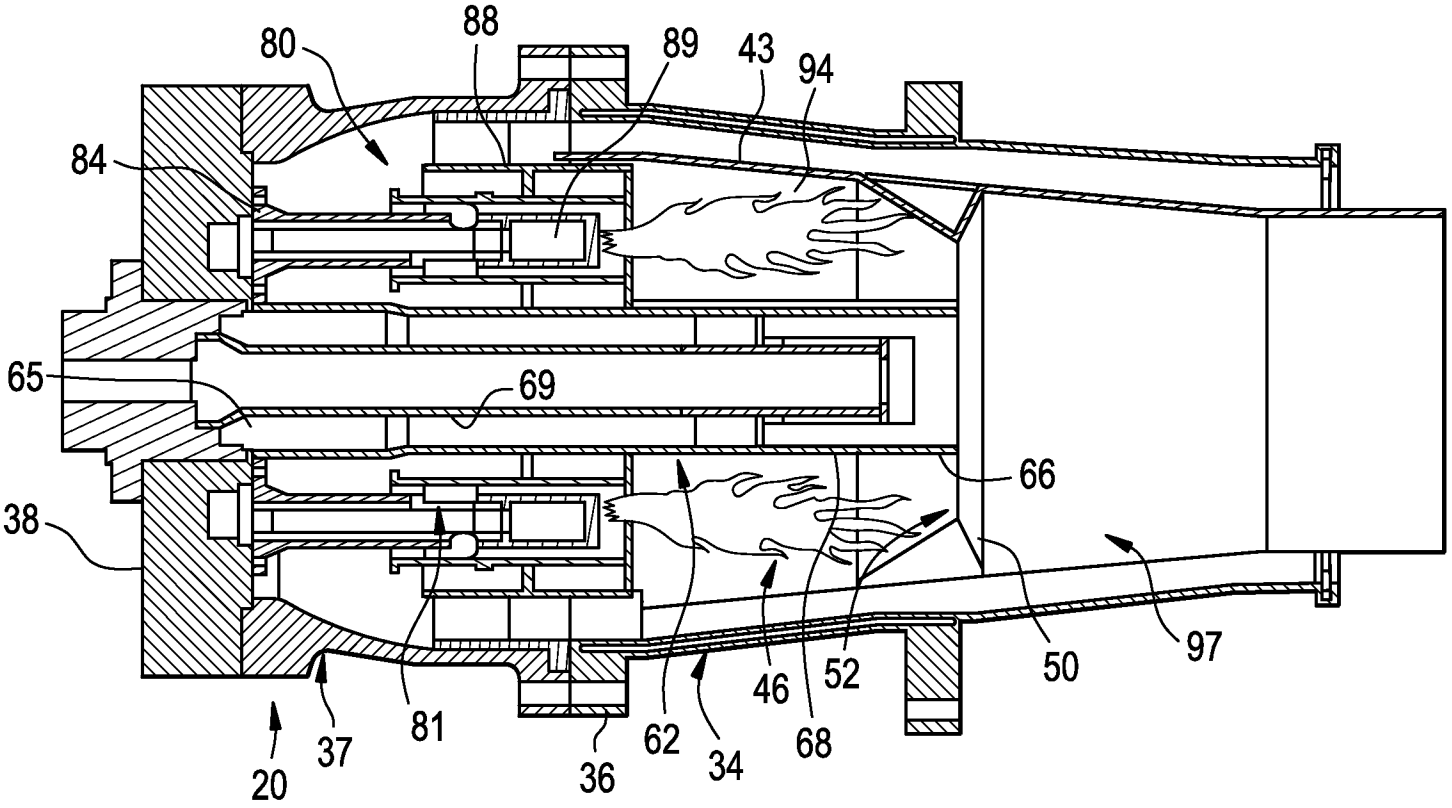
FIG. 3 is a cross-sectional view of the combustor portion of FIG. 1 shown in a part load operational mode.

In accordance with one aspect of the exemplary embodiment, when turbomachine 2 is operated in a turn down mode, a first combustible mixture is introduced through outer injection nozzles 80, 81 into first combustion chamber 94. The first combustible mixture is combusted to form a first combustion reaction (not separately labeled) to form a flame front such as shown in FIG. 3. The flame front creates hot combustion gases that flow through combustion chamber 46, along flow path 130 and into turbine portion 6. By introducing and igniting a pre-mixed combustible mixture, emissions from turbomachine 2 remain low and below prescribed levels when operating in turn down mode. In the turn down mode, fluid, such as air, is passed through center injection nozzle 62 and late lean injectors such as 113 and 114. The fluid passing into center injection nozzle 62 and late lean injectors 113, 114 bypasses the first combustion reaction.

Figure 4:
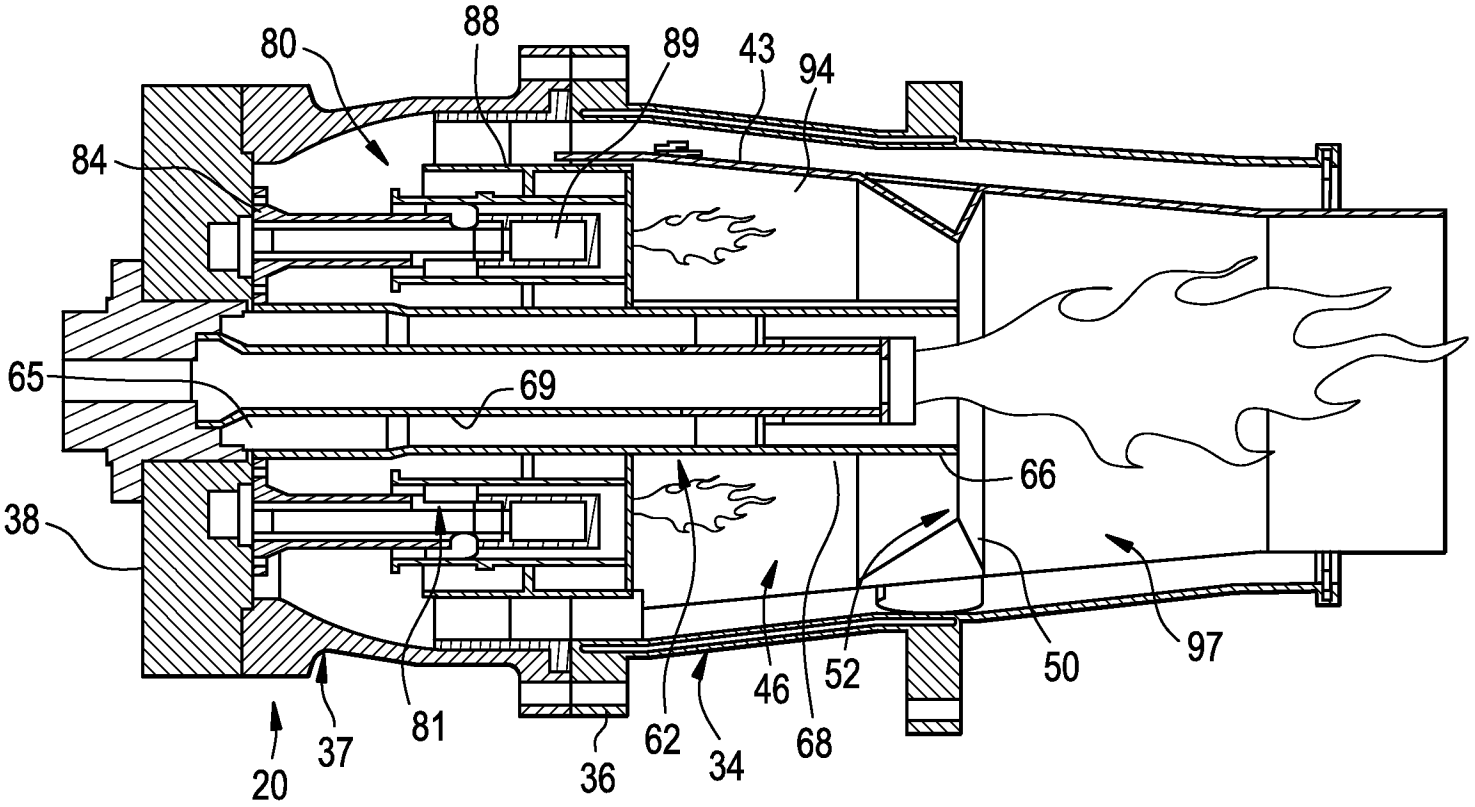
FIG. 4 is a cross-sectional view of the combustor portion of FIG. 3 shown in a first portion of a transfer operational mode.

In order to transition to base load operation, such as shown in FIG. 2, turbomachine 2 enters a first portion of a transfer mode such as shown in FIG. 4. In the first portion of the transfer mode, the first combustible mixture continues to burn in first combustion zone 94 and a second combustible mixture is introduced through center injection nozzle 62 into second combustion zone 97. The second combustible mixture is combusted to form a second combustion reaction forming a second flame front. At the same time, fluid, such as air, is passed into the third combustion zone through, for example, late lean injectors 113 and 114. The fluid passing into the third combustion zone bypasses any combustion reaction in the first and/or second combustion zones.

Figure 5:
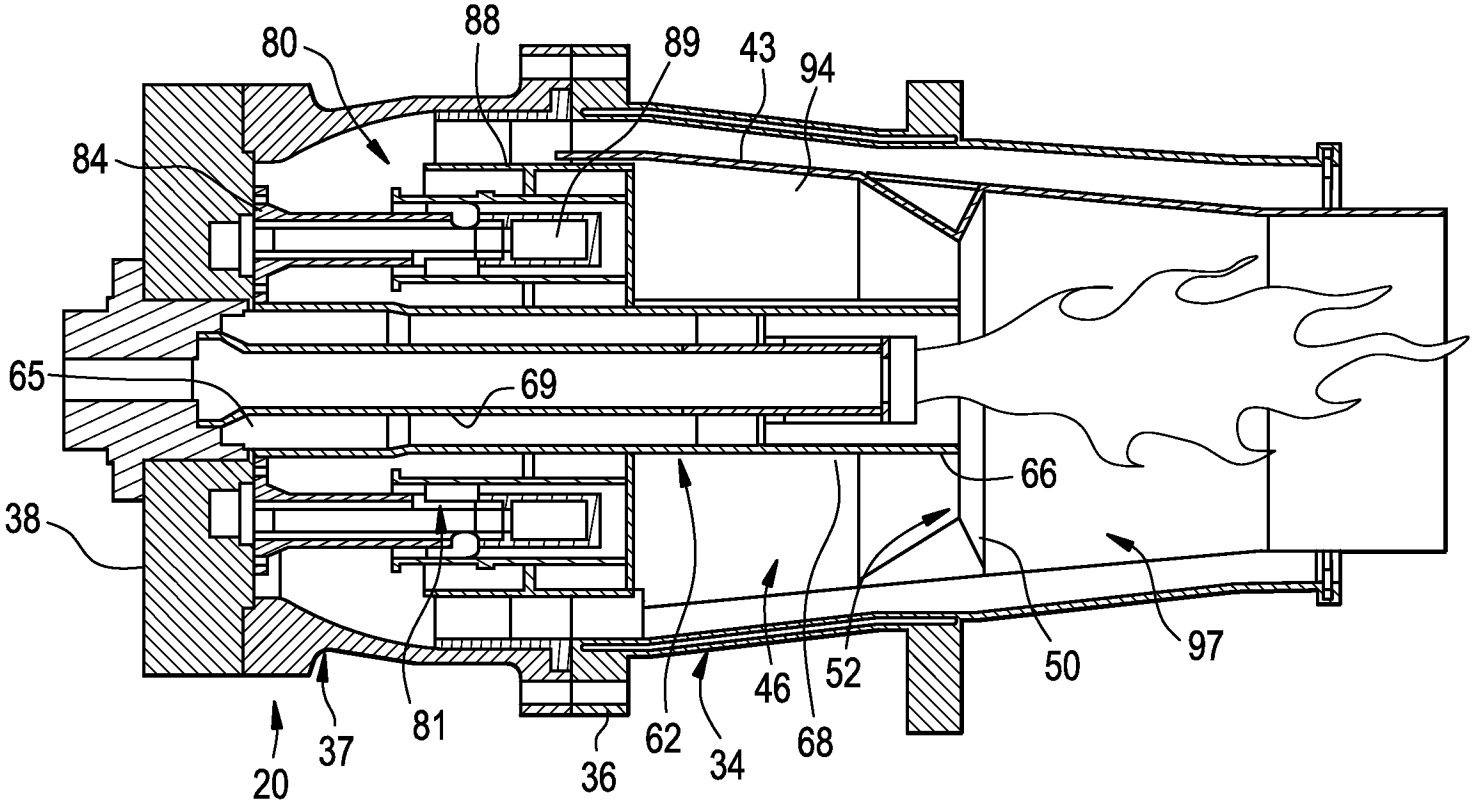
FIG. 5 is a cross-sectional view of the combustor portion of FIG. 4 shown in a second portion of the transfer operational mode.

At a second portion of the transfer mode, such as shown in FIG. 5, a non-combustible fluid (such as air or an extremely fuel-lean mixture) is directed through outer premixed injection nozzles 80, causing the flame in first combustion zone 94 to extinguish. In one variation, fuel from outer premixed injection nozzles 80 is at least partially redirected into center injection nozzle 62. In this second portion of the transfer mode, the second combustible mixture is directed through center injection nozzle 62 and is combusted in second combustion zone 97. Also, if desired, some of the fuel from outer premixed injection nozzles 80 may be directed downstream to late lean injectors 113, 114 (e.g.) for combustion in third combustion zone 125 (shown in FIG. 2).

At this point, turbomachine 2 enters base load operation, as illustrated in FIG. 2. Once in base load, the second combustible mixture creates a flame front that passes from center injection nozzle 62 along a central axis of combustion chamber 46. Venturi throat 52 stabilizes the first combustible mixture to form a second flame front that extends radially outward from the first flame front. In addition, a third combustible mixture is introduced into flow path 130 and ignited in third combustion zone 125. The formation of flame fronts in combustor portion 20 and transition piece 24 produces higher gas stream temperatures that lead to an increase in turbomachine efficiency while at the same time maintaining operation within emissions compliance.

While a combustor assembly 24 having a venturi 50 and venturi throat 52 is shown in FIGS. 2 through 5, it should be understood that exemplary embodiment may include a combustor assembly 24' formed without a venturi such as shown in FIG. 6 wherein like numbers represent corresponding parts in the respective views. FIG. 6 illustrates an exemplary base load operation that results in outer premixed injection nozzles 80 establishing a first flame front in the first combustion zone 94, which is radially outward of center injection nozzle 62. First combustion zone 94 is located upstream of second combustion zone 97 that is created at center nozzle outlet 66. A third combustion zone 125 is located downstream of center injection nozzle 62 (for example, in the transition piece) and, in base load operation, is fueled by late lean injectors 113, 114 or alternatively late lean injectors 115/116 and/or 117/118. In combustor assembly 24' three axially distinct combustion zones 94, 97, and 125 are produced.

At this point, it should be understood that the exemplary embodiments provide a combustor portion having multiple combustion zones that are selectively employed to establish various operating modes for the turbomachine. The multiple combustion zones enable a low turn down mode that maintains emissions compliance while also providing an effective transition to base load. Migrating the flame front away from the outer injection nozzles during transfer from turn down to base load extends an overall operational life of the turbomachine. That is, the inner nozzles are not exposed to the high temperatures associated with base load operation. In this manner, the combustor portion can be fitted with pre-mixed nozzles that produce high gas stream temperatures while also maintaining emissions compliance.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine combustor portion comprising:

a combustor body having a combustor outlet;

a combustion liner arranged within the combustor body, the combustion liner defining therein a combustion chamber;

a center injection nozzle arranged within the combustion chamber, the center injection nozzle having a center nozzle inlet and a center nozzle outlet;

at least one outer premixed injection nozzle positioned radially outwardly of the center injection nozzle, the at least one outer premixed injection nozzle including an outer nozzle inlet and an outer nozzle outlet that is arranged upstream of the center nozzle outlet, the at least one outer premixed injection nozzle establishing a fuel/air mixture of at least 80% homogeneity; and at least one late lean injector positioned downstream of the center injection nozzle and the at least one outer premixed injection nozzle;

wherein the combustor portion includes a first combustion zone arranged downstream of the outer nozzle outlet and upstream of the center nozzle outlet, a second combustion zone arranged downstream of the center nozzle outlet, and a third combustion zone arranged downstream of the first and second combustion zones; and wherein the center injection nozzle, the at least one outer premixed injection nozzle, and the at least one late lean injector are selectively operated to establish a combustion flame front in the first, second, and third combustion zones during a base load operating mode of a turbomachine.

2. The combustor portion according to claim 1, further comprising: a venturi positioned downstream of the at least one outer premixed injection nozzle, the venturi defining a venturi throat.

3. The combustor portion according to claim 2, wherein the venturi is provided on the combustion liner.

4. The combustor portion according to claim 2, wherein the venturi throat is substantially coplanar relative to the center nozzle outlet.

5. The combustor portion according to claim 1, wherein the at least one outer premixed injection nozzle includes a plurality of outer premixed injection nozzles arrayed about the center injection nozzle.

6. The combustor portion according to claim 1, further comprising a transition piece operatively connected to the combustor outlet, the third combustion zone being arranged in one of the combustion liner, the transition piece, and an interface between the combustor outlet and the transition piece.

7. A turbomachine comprising:

a compressor portion;

a turbine portion operatively connected to the compressor portion; and a combustor portion fluidly connected to the turbine portion, the combustor portion comprising:

a combustor body having a combustor outlet;

a combustion liner arranged within the combustor body, the combustion liner defining therein a combustion chamber;

a center injection nozzle arranged within the combustion chamber, the center injection nozzle having a center nozzle inlet and a center nozzle outlet;

at least one outer premixed injection nozzle positioned radially outwardly of the center injection nozzle outlet, the at least one outer premixed injection nozzle establishing a fuel/air mixture of at least 80% homogeneity, the at least one outer premixed injection nozzle including an outer nozzle inlet and an outer nozzle outlet that is arranged upstream of the center nozzle outlet; and at least one late lean injector positioned downstream of the center injection nozzle and the at least one outer premixed injection nozzle, the combustor portion including a first combustion zone arranged downstream of the outer nozzle outlet and upstream of the center nozzle outlet, a second combustion zone arranged downstream of the center nozzle outlet, and a third combustion zone arranged downstream of the first and second combustion zones, wherein the center nozzle, at least one outer premixed injection nozzle, and at least one late lean injector are selectively operated to establish a combustion flame front in the first, second, and third combustion zones during a base load operating mode of the turbomachine.

8. The turbomachine according to claim 7, further comprising: a venturi positioned on the combustion liner downstream of the at least one outer premixed injection nozzle, the venturi defining a venturi throat.

9. The turbomachine according to claim 8, wherein the venturi throat is substantially coplanar relative to the center nozzle outlet.

10. The turbomachine according to claim 7, further comprising a transition piece operatively connected to the combustor outlet, the third combustion zone being arranged in one of the combustion liner, the transition piece, and an interface between the combustor outlet and the transition piece.

11. The turbomachine according to claim 10, wherein the at least one late lean injector is positioned at the third combustion zone.

* * * * *